US008453855B2

(12) United States Patent
Cho

(10) Patent No.: US 8,453,855 B2
(45) Date of Patent: Jun. 4, 2013

(54) TURNING DEVICE FOR HOIST

(75) Inventor: Duck-Rae Cho, Bucheon (KR)

(73) Assignee: KG Inc., Incheon (KR)

( * ) Notice: Subject to any disclaimer, the term of this patent is extended or adjusted under 35 U.S.C. 154(b) by 482 days.

(21) Appl. No.: 12/444,633

(22) PCT Filed: Jan. 24, 2008

(86) PCT No.: PCT/KR2008/000450

§ 371 (c)(1),
(2), (4) Date: Apr. 7, 2009

(87) PCT Pub. No.: WO2008/140174

PCT Pub. Date: Nov. 20, 2008

(65) Prior Publication Data

US 2010/0096353 A1 Apr. 22, 2010

(30) Foreign Application Priority Data

May 9, 2007 (KR) ..... 10-2007-0045144

(51) Int. Cl.
*B66C 19/00* (2006.01)
*B66C 13/08* (2006.01)

(52) U.S. Cl.
CPC ..... *B66C 13/085* (2013.01); *B66C 13/08* (2013.01)
USPC ..... 212/312; 212/275; 254/278

(58) Field of Classification Search
CPC ..... B66C 13/08; B66C 13/085
USPC ..... 212/275, 312, 271; 254/278, 288, 254/289; 294/81.2, 81.21, 74
See application file for complete search history.

(56) References Cited

U.S. PATENT DOCUMENTS

| | | | | | |
|---|---|---|---|---|---|
| 2,721,757 | A | * | 10/1955 | Anderson | 294/81.2 |
| 3,048,370 | A | * | 8/1962 | Kratzer | 254/333 |
| 4,002,321 | A | * | 1/1977 | Shaw et al. | 254/285 |
| 4,214,664 | A | * | 7/1980 | Polen | 212/274 |
| 4,360,112 | A | * | 11/1982 | Brewer et al. | 212/312 |
| 5,074,528 | A | * | 12/1991 | Long, Jr. | 254/285 |
| 5,423,438 | A | * | 6/1995 | Swanson | 212/275 |
| 5,603,420 | A | * | 2/1997 | Swanson | 212/274 |
| 6,827,334 | B2 | * | 12/2004 | Volle et al. | 254/285 |
| 2004/0238805 | A1 | | 12/2004 | Winter | |

FOREIGN PATENT DOCUMENTS

| | | | |
|---|---|---|---|
| JP | 06-166492 | A | 6/1994 |
| JP | 2000-289988 | A | 10/2000 |
| KR | 10-2005-0050212 | A | 5/2005 |
| KR | 100723643 | B1 | 5/2007 |

OTHER PUBLICATIONS

International Search Report of International Application No. PCT/KR2008/000450B filed on Jan. 24, 2008.

* cited by examiner

*Primary Examiner* — Sang Kim
*Assistant Examiner* — Juan Campos, Jr.
(74) *Attorney, Agent, or Firm* — Kile Park Reed & Houtteman PLLC

(57) ABSTRACT

A turning device for a hoist is disclosed, in which a weight thing with a narrow width can be stably turned with a stable support. A rope end unit or an upper sheave unit is easily installed at a hoist frame. A rope end unit or an upper sheave unit is installed in a hoist frame and is freely movable in opposite positions.

5 Claims, 16 Drawing Sheets

TURNING DEVICE FOR HOIST

TECHNICAL FIELD

The present invention relates to a turning device for a hoist, and in particular to a turning device for a hoist which is able to stably support and turn a certain weight thing with a narrow width. A rope ending unit or an upper sheave unit can be easily installed in a hoist frame.

BACKGROUND ART

Generally, a hoist is used when hoisting a certain weight thing. The hoist is provided with a hook at an end of a wining rope for hoisting a weight thing with the help of a driving unit, a gear deceleration device, a brake or something. The hoist is classified into a manual hoist driven with hands, and an electric hoist which uses a motor and is installed on a rail of a crane and moves along the same.

Since the hoist is used for hoisting a weight thing up and down, a certain tuning device is needed when turning the hoisted thing.

FIG. 1 is a perspective view illustrating a turning device for a hoist (utility model number 20-341231) which is connected with a hoist for turning a certain hoisted thing. The turning device 1 comprises a motor 2, a decelerator 3 connected with the motor 2, a brake 4 connected with the decelerator 3, a friction pulley 5 connected with the decelerator 3, and a belt (not shown) of which one end is wound on the friction pulley 5, and the other end is wound on a weight thing for thereby turning the weight thing as the friction pulley 5 is rotated.

In the above turning device, when the friction pulley 5 is rotated, the belt contacting with the same is driven, and the connected weight thing is turned. The conventional turning device 1 is characterized in that a friction force between the friction pulley 5 and the belt decreases when it is used for a long time, so that a certain slippery may occur between the friction pulley 5 and the belt when turning the hoisted weight thing. So, a desired reliable turning work is not obtained. Since the motor 2 is unnecessarily operated, the motor 2 may be aged, and a power consumption increases.

The turning device for a conventional hoist is used in a state that a fixture 6 of the turning device 1 is hung on the hook of the hoist. So, when a large weight thing is hung on the turning device 1, an over weight is applied to the hoist, so that the hoist may be damaged, and a safety accident may occur.

As another problem of the conventional turning device, the turning device 1 is installed at the hook of the hoist during the turning work. When it is needed to use the hoist after the turning work is finished, the turning device 1 should be separated, so that the work process is complicated, and the work time is delayed.

FIG. 2, FIGS. 3 and 4 are views illustrating the turning device (utility model number 20-415071) for a hoist invented by the same applicant as the present application for overcoming the problems of FIG. 1. FIGS. 2 and 3 are a side view and a plane view illustrating a turning device for a hoist. FIG. 4 is a side view illustrating a state of use. The turning device 10 comprises a first hoist unit 11 and a second hoist unit 21, and a connection member 31 for connecting the first and second hoist units 11 and 21.

The first and second hoist units 11 and 21 are provided with the first and second hoist frames 12, and 22, respectively. The first and second hoist frames 12 and 22 comprise a pair of first installation brackets 13 and a pair of second installation brackets 23, and a first support bracket 14 and a second support bracket 24 installed between the first and second installation brackets 13 and 23 for supporting the same. In the inner sides of the first and second installation brackets 13 and 23, a first wire drum 15 and a second wire drum 25 wound with a first wire rope 16 and a second wire rope 26 are installed, respectively.

A first upper sheave 17 and a second upper sheave 27 are fixed at the lower sides of the first and second support brackets 14 and 24, and the first wire rope 16 and the second wire rope 26 wound on the first and second wire drums 15 and 25 are connected with the first and second hook units 18 and 28 through the first and second upper sheaves 17 and 27.

The first and second hook units 18 and 28 comprise a first lower sheave 20 and a second lower sheave 30 connected with the first and second wire ropes 16 and 26, respectively, and a first hook 19 and a second hook 29 installed in the first and second lower sheaves 20 and 30, respectively. A wire 35 is connected with the first hook 19 and the second hook 29 for turning the weight thing 36.

The connection member 31 comprises first auxiliary wheels 32 and second auxiliary wheels 33 installed in the first and second installation brackets 13 and 23, respectively, and a connection bracket 34 for connecting the first and second auxiliary wheels 32 and 33.

In the turning device for a conventional hoist, since the friction pulley 5 of FIG. 1 is not used, a slippery does not occur between parts even when it is used for a long time, and a driving transfer work is reliable between the parts. In addition, the weight thing 36 is supported by means of the first hook 19 of the first hoist unit 11 and the second hook 29 of the second hoist unit 21, respectively, so that the entire weight is divided into two hoist units 11 and 21 for thereby decreasing the over load in the turning device.

As shown in FIG. 4, in the turning device for a conventional hoist, when a certain weight thing 36 having a narrow width is turned, a worse problem may occur. Namely, in the turning device for a conventional hoist, since a space between the first and second hook units 18 and 28 is relatively wide, when a narrow weight thing is hoisted by hanging it to the wire 35, the wire 35 is not closely contacted with both sides of the weight thing 36.

The first and second hook units 18 and 28 are generally installed with a relatively wider space for the following reasons.

The connection member 31 is provided between the first and second installation brackets 13 and 23 for connecting the first and second hoist units 11 and 21. Since the space between the first and second hoist units 11 and 21 is widened owing to the connection member 31, the space between the first and second upper sheaves 17 and 27 is widened as well.

The first and second support brackets 14 and 24 with the first and second upper sheaves 17 and 27 are installed at the outer sides of the first and second wire drums 15 and 25, respectively. So, the space between the first and second upper sheaves 17 and 27 installed in the first and second support brackets 14 and 24 is widened as well.

In the turning device for a conventional hoist, the space between the first and second upper sheaves 17 and 27 is relatively wider. So, when a weight thing 36 with a narrow width is hoisted, the wire 35 is not closely contacted with both sides of the weight thing 36 as shown in FIG. 4.

When the wire 35 is not closely contacted with both sides of the weight thing 36 in a state the wire 35 is largely spaced apart from the both sides of the weight thing 36, it is impossible to keep the weight thing 36 balanced, and the weight thing 36 may largely swing by means of a certain external force.

In the above state, when a turning work is performed, the weight thing 36 may be tiled in one direction, and the weight center is moved. So, the part of the turning device 10 including the wire 35 may be severely damaged. When the parts are damaged, the weight thing 36 may fall down for thereby causing a safety accident.

DISCLOSURE OF INVENTION

Technical Problem

Accordingly, it is an object of the present invention to provide a turning device for a hoist in which a weight thing with a narrow width can be stably turned with a stable support.

It is another object of the present invention to provide a turning device for a hoist in which a rope end unit or an upper sheave unit is easily installed at a hoist frame.

It is further another object of the present invention to provide a turning device for a hoist in which a rope end unit or an upper sheave unit is installed in a hoist frame and is freely movable in opposite positions.

Technical Solution

To achieve the above objects, there is provided a turning device for a hoist which comprises a hoist frame which includes a pair of installation brackets having a first wire drum wound with a first wire rope, and a second wire drum wound with a second wire rope, a pair of support brackets disposed between the first and second wire drums and supported by two installation brackets, and first and second auxiliary brackets fixed in the support brackets, respectively; a first drum driving unit which includes a first winding motor installed at one side of the installation bracket, a first decelerator connected with the first winding motor and the first wire drum, respectively, and a first brake connected with the first decelerator; a second drum driving unit which includes a second winding motor installed at the other side of the installation bracket, a second decelerator connected with the second winding motor and the second wire drum, respectively, and a second brake connected with the second decelerator; a first horizontal driving unit which includes a first horizontal wheel installed at one of a pair of the installation brackets, and a first horizontal motor which is connected with the first horizontal wheel for thereby rotating the same; a second horizontal driving unit which includes a second horizontal wheel installed at one of a pair of the installation brackets, and a second horizontal motor connected with the second horizontal wheel for rotating the same; a first wire rope guide member which is disposed between a pair of the support brackets and is rotatably installed at one side of each of the first and second auxiliary brackets, with a first wire rope passes through the first wire rope guide member; a second wire rope guide member which is disposed between a pair of the support brackets and is rotatably installed at the other side of each of the first and second auxiliary brackets, with a second wire rope passing through the second wire rope guide member; a first hook unit which is positioned at a lower side of the first wire rope guide member, with a first wire rope passing through the first hook unit; a second hook unit which is positioned at a lower side of the second wire rope guide member, with a second wire rope passing through the second hook unit; and turnover jiggers of which an upper end of each jigger is connected with the first and second hook units, respectively, and a lower end of each jigger is supported by means of a weight thing H.

The first and second auxiliary brackets are provided with a first pin groove and a second pin groove which have an upper open portion, and a lower concave portion.

The first and second wire rope member are first and second rope ending units which include first and second fixing pieces to which an end of each of the first and second wire ropes is fixed, first and second engaging pieces of which lower ends are engaged to the first and second fixing pieces with the first and second engaging pins, and first and second hinge pins which are provided at both sides of the upper ends of the first and second engaging pieces and are formed of the first and second hinge pins mounted in the first and second pin grooves.

The first and second wire rope guide member are first and second upper sheave units which include first and second upper sheaves through which the first and second wire ropes pass, first and second upper sheave brackets installed at both sides of the first and second upper sheaves, and first and second hinge pins which are provided at both sides of the first and second upper sheave brackets and are mounted in the first and second pin grooves.

The first and second hook units comprise first and second lower sheaves through which the first and second wire ropes pass, first and second lower sheave brackets installed at both sides of the first and second lower sheaves and have first and second installation grooves having center lower sides in which the upper ends of the hooks are positioned, and first and second engaging pieces which traverse the first and second installation grooves and of which both ends are fixed at the first and second lower sheave brackets, respectively, with the hooks being fixed at the center portions of the same.

The turnover jigger comprises a first turnover jigger which includes a first spacer bar positioned at a lower side of the first hook unit, a first connection wire connected to the first hook unit and both sides of the first spacer bar, and a first turnover wire connected to both sides of the first spacer bar and wound on the weight thing H; a second turnover jigger which includes a second spacer bar positioned at a lower side of the second hook unit, a second connection wire connected with the second hook unit and both sides of the second spacer bar, and a second turnover wire which is connected with both sides of the second spacer bar and wound on the weight thing H; and a connection piece which is connected with the first and second turnover wires, respectively.

The turnover jigger comprises a first spacer bar positioned at a lower side of the first hook unit; a first connection wire connected with the first hook unit and both sides of the first spacer bar; a second spacer bar positioned at a lower side of the second hook unit; a second connection wire connected with the second hook unit and both sides of the second spacer bar; and an integral turnover wire which is connected with both sides of each of the first and second spacer bars and is wound on the weight thing H.

The first and second spacer bars of the turnover jigger are provided with a plurality of space adjusting holes so that the upper ends of the first and second turnover wires are selectively engaged.

The first and second spacer bars of the turnover jigger comprise first unit bars having a plurality of space adjusting holes; second unit bars which have ends slide-inserted into the first unit bars, and space adjusting holes formed at the portions in which the first unit bars are inserted, and being opposite to the space adjusting holes; and an engaging pin which is engaged to the space adjusting holes of the first unit bars and the second unit bars, respectively, for thereby fixing the first unit bars and the second unit bars.

Therefore, the first and second wire drums are installed in an integral installation bracket, and the first and second auxiliary brackets are disposed between the first and second wire drums, and the first and second rope guide members are engaged to the first and second auxiliary brackets, respectively. So, the first and second guide members are installed as close as possible, so that the first and second wire ropes, the first and second hook units connected with the first and second wire ropes, and the first and second turnover jiggers connected with the first and second hook units are installed as close as possible, respectively. Therefore, even when a certain weight thing with a narrow width is supported by means of the turnover jiggers, since the first and second turnover wires are closely contacted with both sides of the weight thing, the weight thing is stably supported. During the turnover work, the weight thing is not largely inclined or is not largely swung.

The first and second rope guide members can be easily installed in the hoist frame by mounting a first hinge pin of the first rope guide member and a second hinge pin of the second rope guide member into a first pin groove of the first auxiliary bracket and a second pin groove of the second auxiliary bracket, respectively. When the installed first and second rope guide members are lifted from the first and second auxiliary brackets, they can be easily separated. Since the works for installing or separating the first and second rope guide members from the hoist frame are very easy, the assembling process and maintenance work are very fast and simple.

In addition, when the first hinge pin of the first rope guide member and the second hinge pin of the second rope guide member are installed in the first pin groove of the first auxiliary bracket and the second pin groove of the second auxiliary bracket, respectively, the first and second rope guide members are freely movable about the first and second pin grooves in opposite directions. When the space between the first and second wire ropes is widened or narrowed depending on the width of the weight thing, the first and second rope guide members are properly movable about the first and second pin grooves depending on a varying space between the first and second wire ropes. When the angle between the first and second wire ropes increases or decreases, the angle between the first and second rope guide members increases and decreases for thereby preventing a bending phenomenon of the first and second wire ropes passing through the first and second rope guide members. So, fatigue is focused on part of the rope, so that it is possible to a damage of the same.

The turnover jigger of the present invention is able to properly adjust the space between a pair of the first turnover wires and a space between a pair of the second turnover wires. So, even when the width of both sides of a weight thing is wider or narrower, the four portions of both sides of a weight thing are stably supported by means of the turnover jigger of the present invention.

A first hook or a second hook or one large capacity hook can be selectively installed in the first and second hook units of the present invention. A turnover jitter may be installed along with one of the above elements. The turnover jigger is used when a weight thing is turned over, and one large capacity hook installed in the first and second hook units is used when horizontally rotating the weight thing. When a certain weight thing is simply moved, the first or second hook unit or one large capacity hook is used. So, in the present invention, it is possible to easily perform a vertical turn work, a horizontal rotation work or a transfer work.

Advantageous Effects

In the present invention, when a weight thing with a narrow width is supported by means of the turnover jigger, since the first and second turnover wires are closely contacted with both sides of the weight thing, the weight thing can be stably supported. When the angle between the first and second wire ropes increases or decreases, the angle between the first and second rope guide members increases or decreases as well, so that the first and second wire ropes passing through the first and second rope guide members are prevented from being bended. Even when a width of both sides of the weight thing is wide or narrow, it is possible to stably support four portions of both sides of the weight thing with the help of the turnover jigger, so that a vertical turn work, a horizontal rotation work and a transfer work can be easily performed.

BRIEF DESCRIPTION OF THE DRAWINGS

The present invention will become better understood with reference to the accompanying drawings which are given only by way of illustration and thus are not limitative of the present invention, wherein.

BEST MODE FOR CARRYING OUT THE INVENTION

Figure 1:
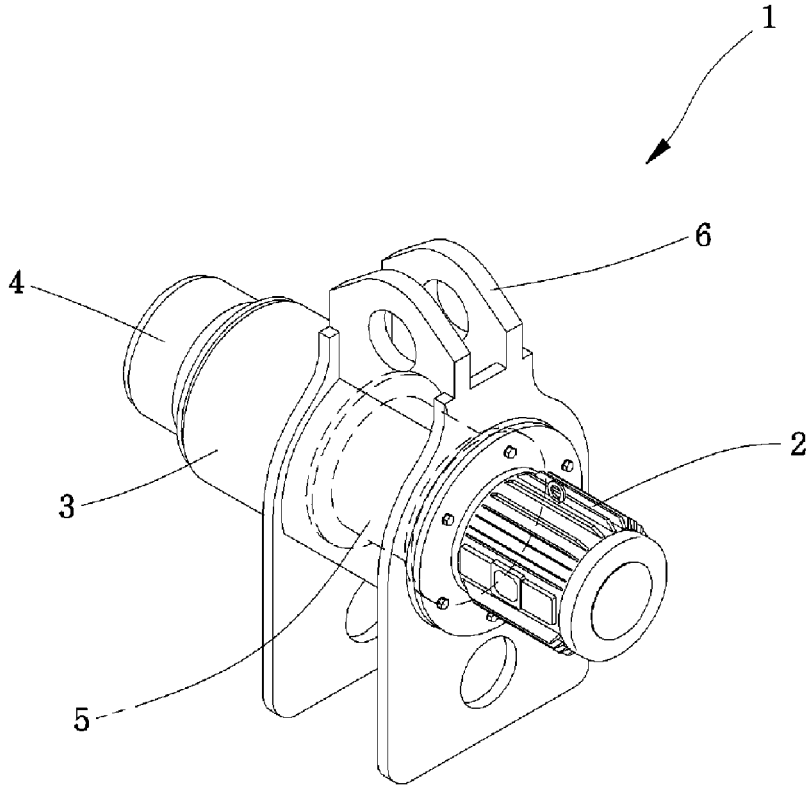
FIG. 1 is a schematic perspective view illustrating a conventional turning device.
Figure 2:
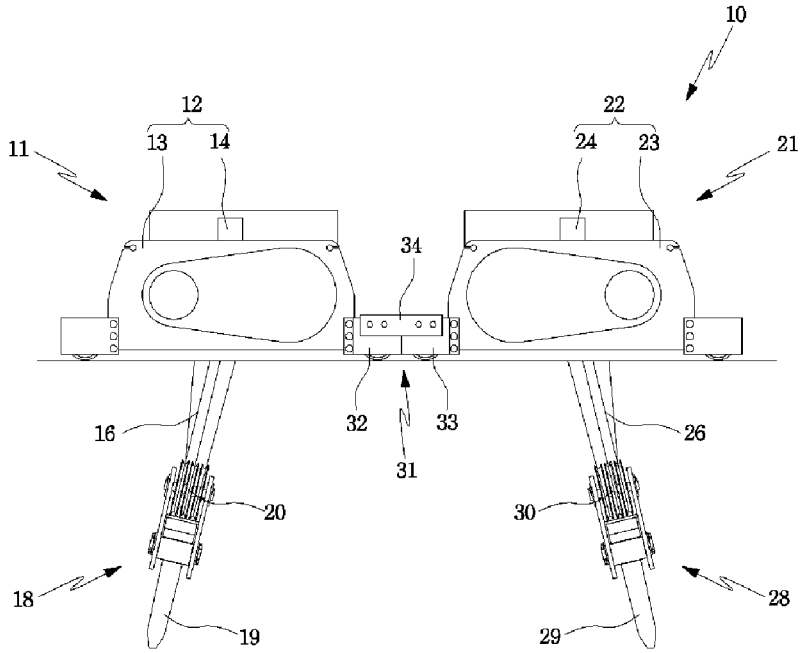
FIGS. 2 and 3 are a front view and a plane view of a turning device for a conventional hoist.
Figure 3:
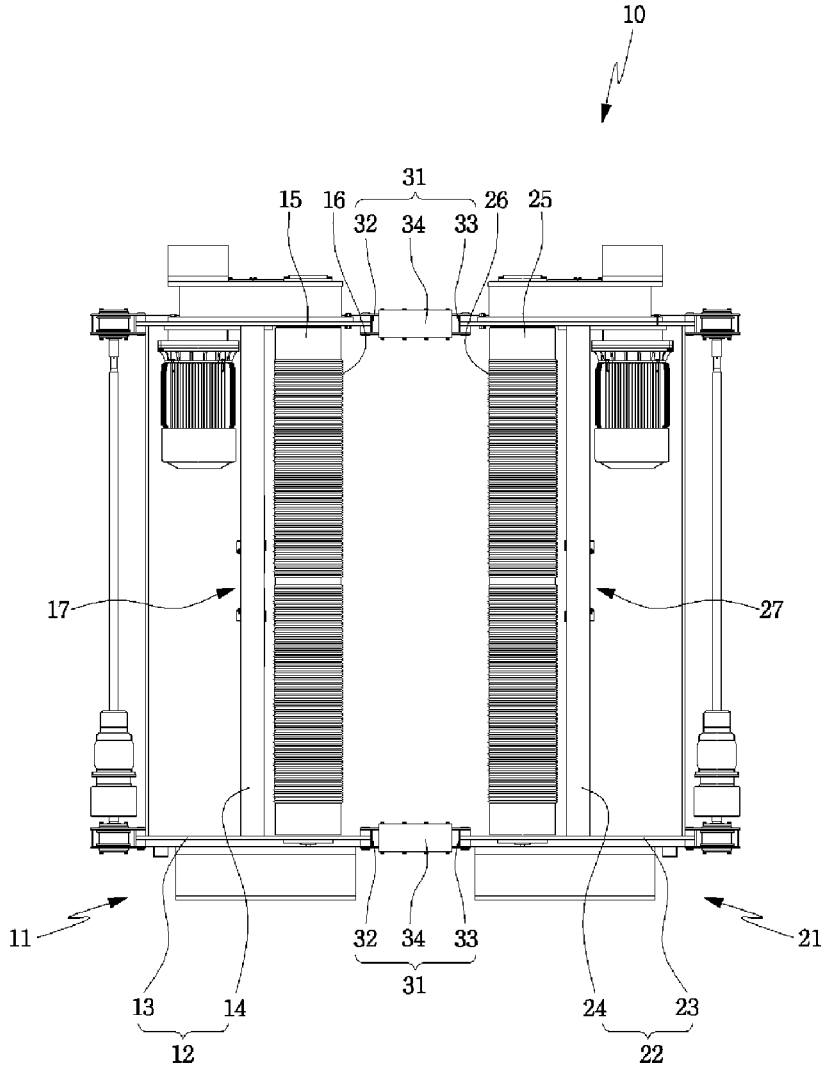
Figure 4:
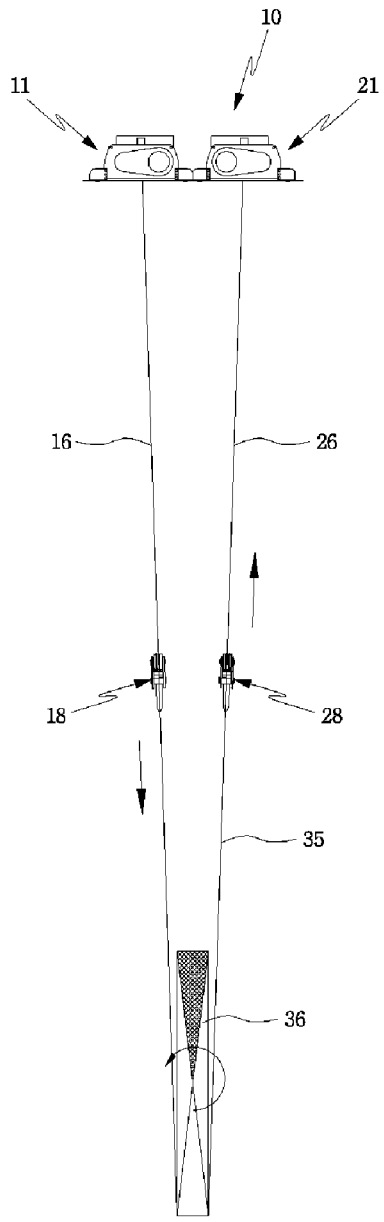
FIG. 4 is a schematic view illustrating a state of use for describing a problem of a turning device for a conventional hoist.

In the present invention, the turning device for a hoist comprises a hoist frame 40 which includes a pair of installation brackets 41 having a first wire drum 51 wound with a first wire rope 52, and a second wire drum 53 wound with a second wire rope 54, a pair of support brackets 42 disposed between the first and second wire drums 51 and 53 and supported by two installation brackets 41, and first and second auxiliary brackets 43 and 45 fixed in the support brackets, respectively; a first drum driving unit 60 which includes a first winding motor 61 installed at one side of the installation bracket 41, a first decelerator 62 connected with the first winding motor 61 and the first wire drum 51, respectively, and a first brake 63 connected with the first decelerator 62; a second drum driving unit 70 which includes a second winding motor 71 installed at the other side of the installation bracket 41, a second decelerator 72 connected with the second winding motor 71 and the second wire drum 53, respectively, and a second brake 73 connected with the second decelerator 72; a first horizontal driving unit 120 which includes a first horizontal wheel 121 installed at one of a pair of the installation brackets 41, and a first horizontal motor 122 which is connected with the first horizontal wheel 121 for thereby rotating the same; a second horizontal driving unit 130 which includes a second horizontal wheel 131 installed at one of a pair of the installation brackets 41, and a second horizontal motor 132 connected with the second horizontal wheel 131 for rotating the same; a first wire rope guide means which is disposed between a pair of the support brackets 42 and is rotatably installed at one side of each of the first and second auxiliary brackets 43 and 45, with a first wire rope 52 passes through the first wire rope guide means; a second wire rope guide means which is disposed between a pair of the support brackets 42 and is rotatably installed at the other side of each of the first and second auxiliary brackets 43 and 45, with a second wire rope 54 passing through the second wire rope guide means; a first hook unit 140 which is positioned at a lower side of the first wire rope guide means, with a first wire rope 52 passing through the first hook unit; a second hook unit 150 which is positioned at a lower side of the second wire rope guide means, with a second wire rope passing through the second hook unit; and turnover jiggers 170, 210, 220 and 230 of which an upper end of each jigger is connected with the first and second hook units 140 and 150, respectively, and a lower end of each jigger is supported by means of a weight thing H.

Mode for the Invention

The features and advantages of the present invention will be described with reference to the accompanying drawings.

Figure 5:
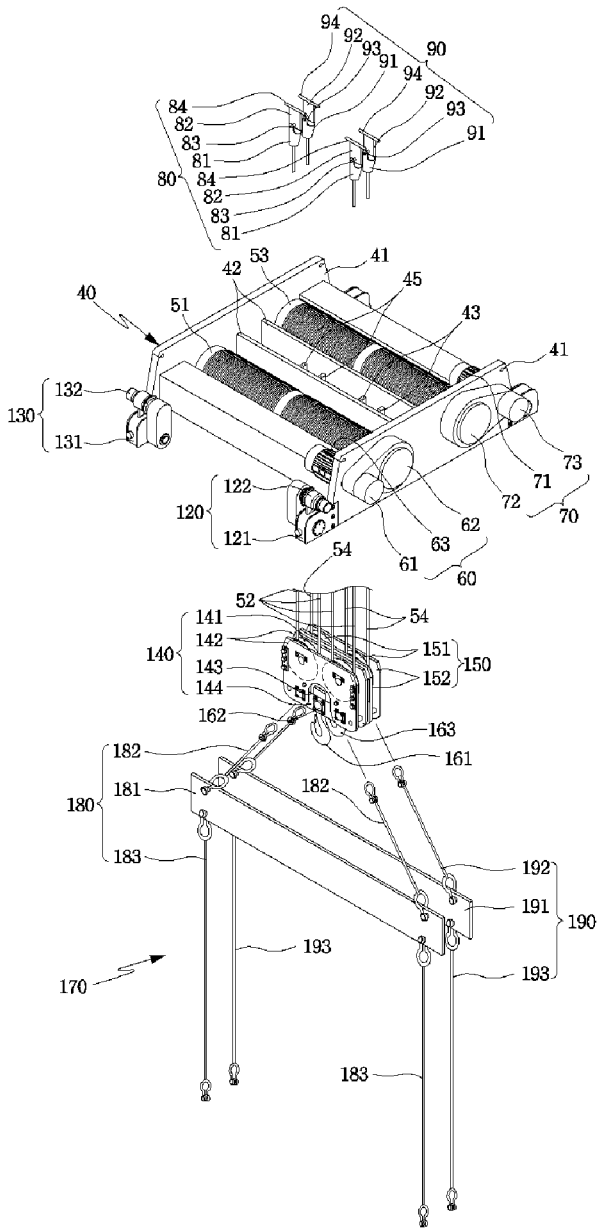
FIG. 5 is a schematic view illustrating a turning device for a hoist according to the present invention.
Figure 6:
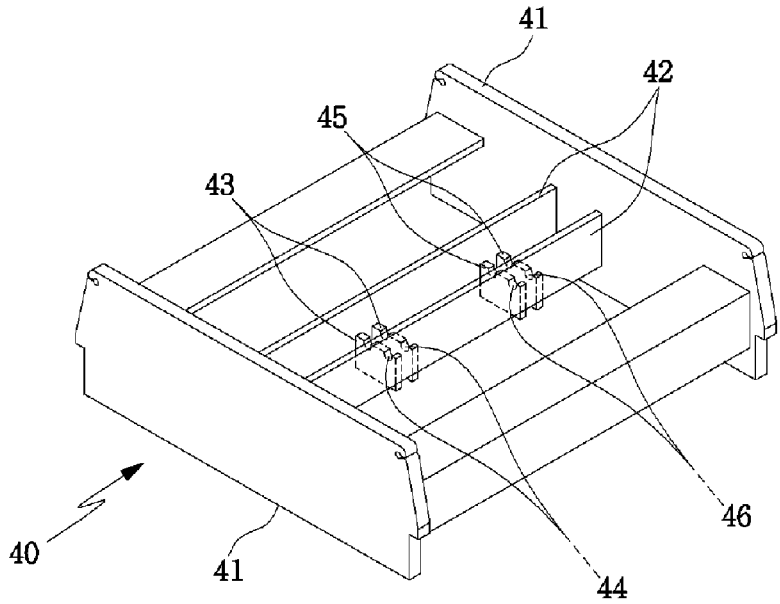
FIG. 6 is a perspective view illustrating a hoist frame of FIG. 5.
Figure 7:
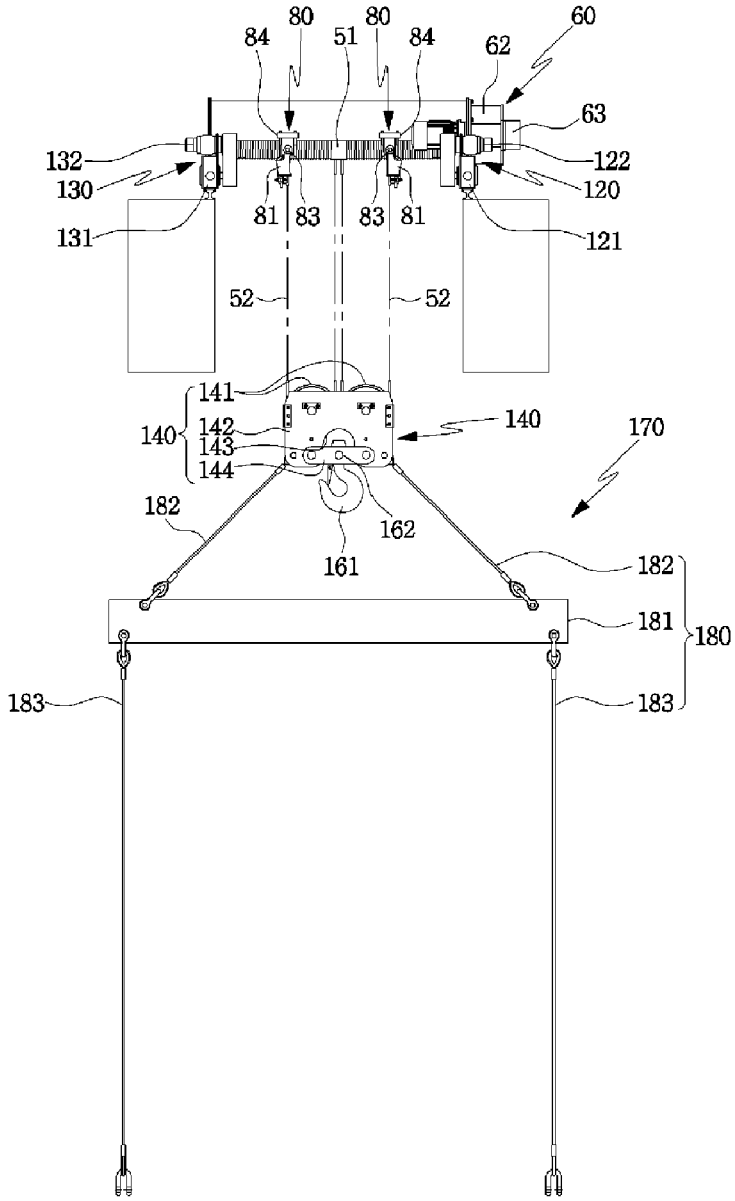
FIGS. 7 through 9 are a front view, a side view and a plane view of FIG. 5.
Figure 8:
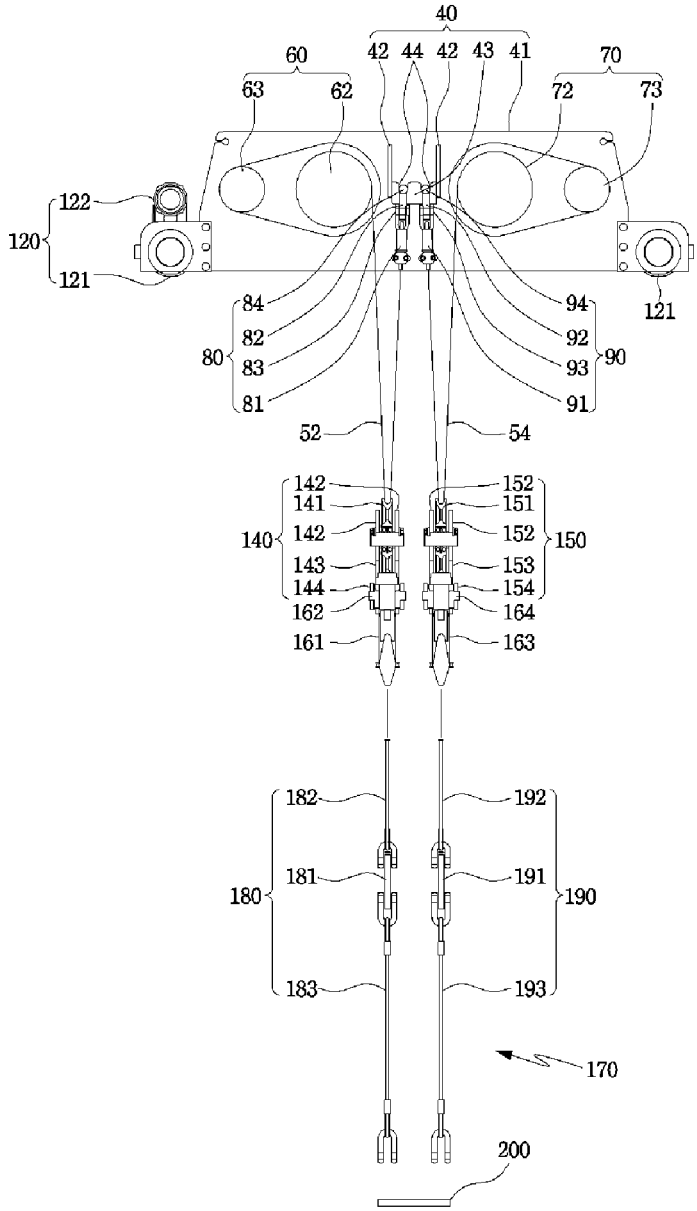
Figure 9:
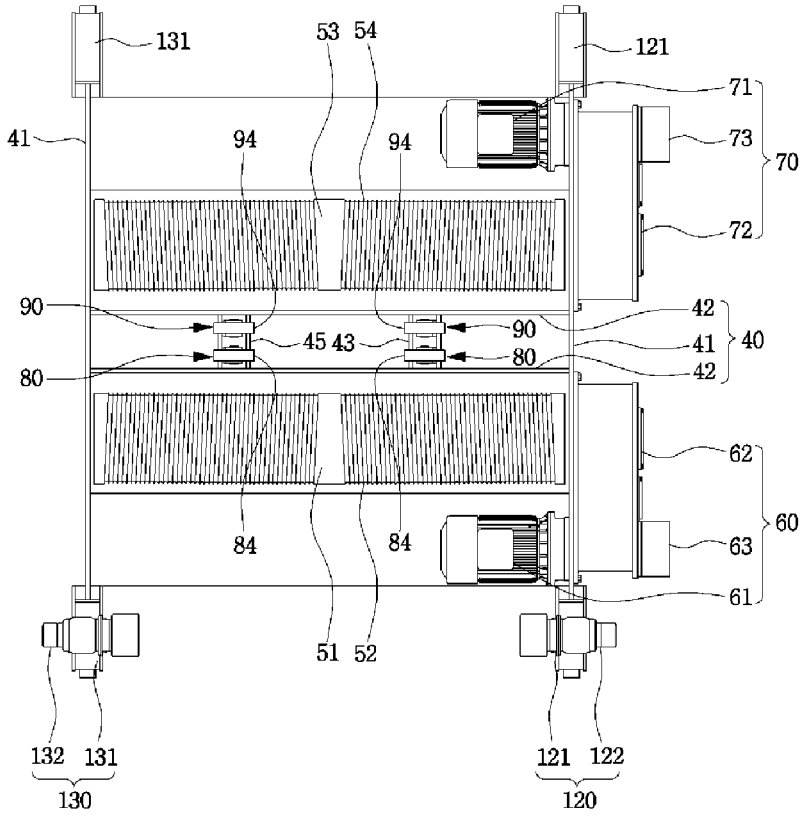

FIG. 5 is a schematic perspective view illustrating a turning device for a hoist according to the present invention, FIG. 6 is a perspective view illustrating a hoist frame of FIG. 5, and FIGS. 7 through 9 are a front view, a side view and a plane view of FIG. 5.

The turning device for a hoist according to the present invention comprises a hoist frame 40, a first drum driving unit 60 and a second drum driving unit 70, a first rope guide member and a second rope guide member, a first horizontal driving unit 120 and a second horizontal driving unit 130, a first hook unit 140 and a second hook unit 150, and a turnover jitter 170.

Here, the hoist frame 40 comprises an integral installation bracket 41, a support bracket 42, a first auxiliary bracket 43, and a second auxiliary bracket 45. The installation brackets 41 are provided in one pair with a certain space between the same, and the first wire drum 51 wound with the first wire rope 52 and the second wire drum 53 wound with the second wire rope 54 are installed in the installation brackets 41, respectively.

The support bracket 42 is disposed between the first and second wire drums 51 and 53 and is supported by means of two installation brackets 41. Since two support brackets 42 are disposed between the first and second wire drums 51 and 53, the space between two support brackets 42 is relatively narrow.

The first and second auxiliary brackets 43 and 45 are fixed between a pair of the support brackets 42. The first and second auxiliary brackets 43 and 45 are installed at two points of the support brackets 42, respectively, and support the first and second rope guide members.

The first and second pin grooves 44 being open upwards and being concave downwards are formed on the upper sides of the first and second auxiliary brackets 43 and 45, respectively. The first hinge pin 84 of the first rope guide member and the second hinge pin 94 of the second rope guide member are mounted in the first and second pin grooves 44 and 46.

Since the first and second pin grooves 44 and 46 are open upwards, when the first and second hinge pins 84 and 94 are mounted on the same, respectively, and are inserted, so that the first and second hinge pins 84 and 94 are mounted in the first and second pin grooves 44 and 46, and when the mounted first and second hinge pins 84 and 94 are lifted up, they are separated from the first and second pin grooves 44 and 46.

In the hoist frame 40, the first and second rope guide members installed in the first and second auxiliary brackets 43 and 45 are installed as closer as possible with the helps of the support bracket 42 installed between the first and second wire drums 51 and 53 with a relatively narrower width, and the first and second auxiliary brackets 43 and 45 installed in the support bracket 42.

The first drum driving unit 60 comprises a first winding motor 61 installed at one side of the installation bracket 41, a first decelerator 62 connected with the first winding motor 61 and the first wire drum 51, and a first brake 63 connected with the first decelerator 62. When the first winding motor 61 is driven, a rotational force of the drum driving unit 60 is transferred to the first wire drum 51 through the first decelerator 62, and as the first wire drum 51 rotates, the first wire rope 52 wound on the same is wound or loosened.

The second drum driving unit 70 comprises a second winding motor 71 installed at the other side of the installation bracket 41, a second decelerator 72 connected with the second winding motor 71 and the second wire drum 53, and a second brake 73 connected with the second decelerator 72. When the second winding motor 71 is driven, a rotational force of the second drum driving unit 70 is transferred to the second wire drum 53 through the second decelerator 72. As the second wire drum 53 rotates, the second wire rope 54 wound on the same is wound or loosened.

The first horizontal driving unit 120 comprises a first horizontal wheel 121 installed in one of a pair of the installation brackets 41, and a first horizontal motor 122 connected with the first horizontal wheel 121 for rotating the same. When the first horizontal motor 122 is driven, a rotational force of the first horizontal driving unit 120 is transferred to the first horizontal wheel 121, and as the first horizontal wheel 121 rotates, the turning device of the present invention is transferred along a rail of the crane.

The second horizontal driving unit 130 comprises a second horizontal wheel 131 installed in one of a pair of the installation brackets 41, and a second horizontal motor 132 connected with the second horizontal wheel 131 for rotating the same. When the second horizontal motor 132 is driven along with the first horizontal motor 122, a rotational force of the second horizontal driving unit 130 is transferred to the second horizontal wheel 131. As the second horizontal wheel 131 rotates along with the first horizontal wheel 121, the turning device of the present invention is transferred along a rail of the crane.

The first wire rope guide member is disposed between a pair of the support brackets 42 and is rotatably installed at one side of the first auxiliary bracket 43 and includes a first wire rope 52 fixedly connected with one end of the first wire rope 52. The first rope ending unit 80 comprises a first fixing piece

81 fixedly connected with one end of the first wire rope 52, a first engaging piece 82 of which a lower end is engaged to the first fixing piece 81 through a first engaging pin 83, and a first hinge pin 84 which is provided at both sides an upper end of the first engaging piece 82 and is mounted in the first pin grooves 44, respectively.

The second wire rope guide member is disposed between a pair of the support brackets 42 and is rotatably installed at the other side of the second auxiliary bracket 45 and includes a second rope ending unit 90 fixedly connected with one end of the second wire rope 54. Here, the second rope ending unit 90 comprises a second fixing piece 91 fixedly connected with one end of the second wire rope 54, a second engaging piece 92 engaged to the second fixing piece 91 through a second engaging pin 93, and a second hinge pin 94 which is provided at both sides of an upper end of the second engaging piece 92 and is mounted in the second pin groove 46.

The first and second rope ending units 80 and 90 are detachably installed between the hoist frames 40, namely, the first and second rope ending units 80 and 90 can be easily installed in the hoist frames 40 as the first hinge pin 84 of the first rope ending unit 80 and the second hinge pin 94 of the second rope ending unit 90 are mounted in the first pin groove 44 of the first auxiliary bracket 43 and the second pin groove 46 of the second auxiliary bracket 45. The installed first and second rope ending unit 80 and 90 can be lifted from the first and second auxiliary brackets 43 and 45 for thereby separating the same. Since the works for installing and separating the first and second rope ending units 80 and 90 from the hoist frames 40 are very easy, the assembling and maintenance works are fast and easy.

In the first rope ending unit 80, when the first and second hinge pins 84 and 94 are installed in the first pin groove 44 of the first auxiliary bracket 43 and the second pin groove 46 of the second auxiliary bracket 45, the first and second rope guide members are freely movable in opposite directions with respect to the first and second pin grooves 44 and 46. When the space between the first and second wire ropes 52 and 54 is widened or narrowed depending the width of the weight thing H to be turned, the first and second rope ending units 80 and 90 properly rotate with respect to the first and second pin grooves 44 and 46 depending on the space between the first and second wire ropes 52 and 54.

Figure 11:
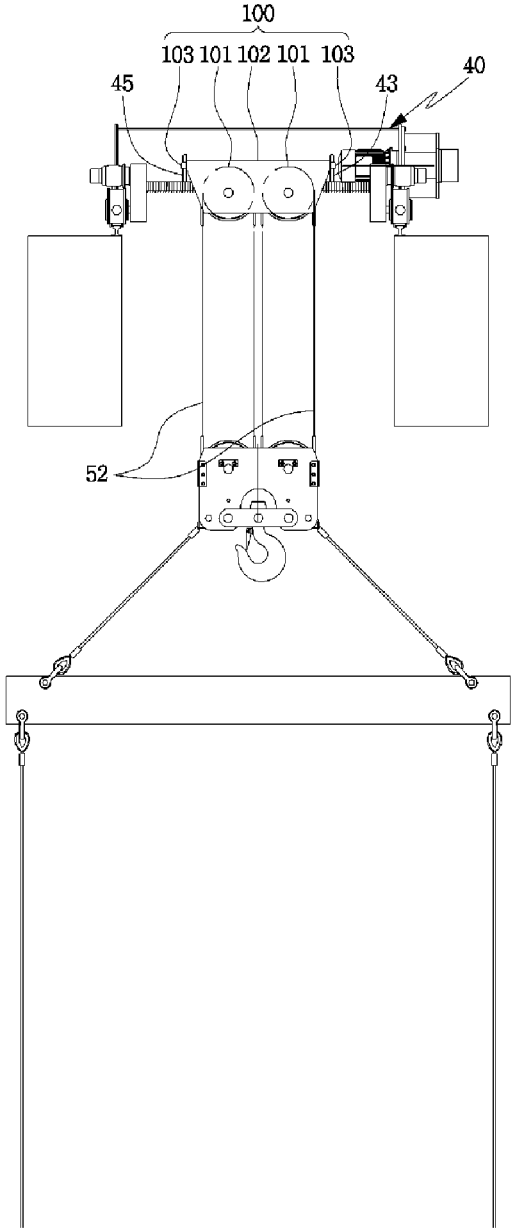
FIGS. 11 and 12 are a front view and a plane view illustrating a state that a first upper sheave unit and a second upper sheave unit are installed in a hoist frame.
Figure 12:
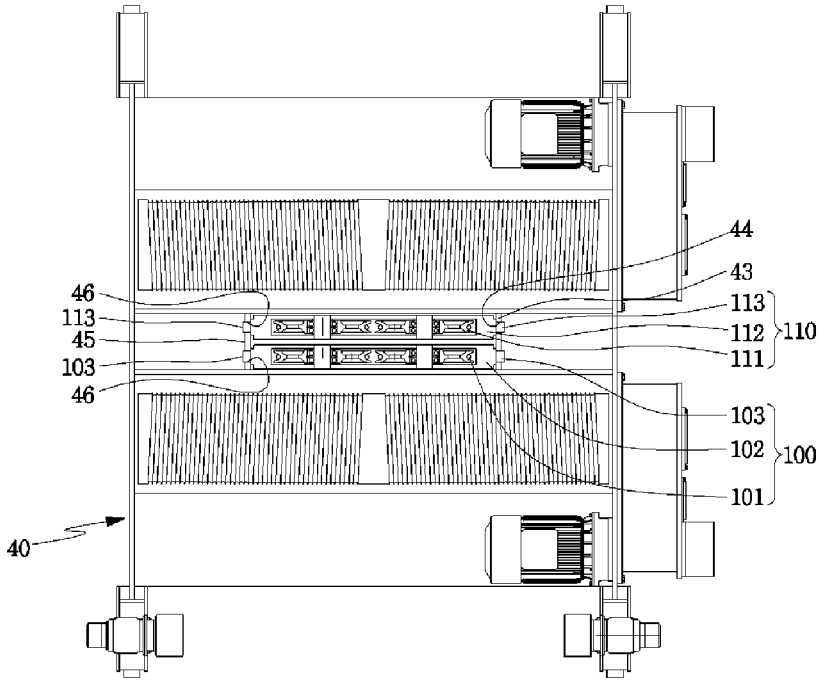

As shown in FIGS. 11 and 12, the first and second wire rope guide members may be formed of a first upper sheave unit 100 and a second upper sheave unit 110.

The first upper sheave unit 100 comprises a first upper sheave 101 through which the first wire rope 52 passes, a first upper sheave bracket 102 installed at both sides of the first upper sheave 101, and a first hinge pin 103 provided at both sides of the first upper sheave bracket 102 and mounted in the first pin groove 44, respectively.

The second upper sheave unit 110 comprises a second upper sheave 111 through which the second wire rope 54 passes, a second upper sheave bracket 112 installed at both sides of the second upper sheave 111, and a second hinge pin 113 provided at both sides of the second upper sheave bracket 112 and mounted in the second pin groove 46, respectively.

Here, the first upper sheave unit 100 and the second upper sheave unit 110 can be easily installed in the hoist frame 40 like the first and second rope ending units 80 and 90 and can be easily separated from the same. When the first hinge pin 103 of the first upper sheave unit 100 and the second hinge pin 113 of the second upper sheave unit 110 are mounted in the first pin groove 44 of the first auxiliary bracket 43 and the second pin groove 46 of the second auxiliary bracket 45, the first and second upper sheave units 100 and 110 can be easily installed in the hoist frame 40. The separation process is performed in a reverse sequence.

Since the first and second upper sheave units 100 and 110 are freely movable in opposite directions like the first and second rope ending units 80 and 90, when the space between the first and second wire ropes 52 and 54 is widened or narrowed depending on the width of the weight thing H to be turned, the first and second upper sheave units 100 and 110 can properly rotate with respect to the first and second pin grooves 44 and 46 depending on the space between the first and second wire ropes 52 and 54.

Figure 13:
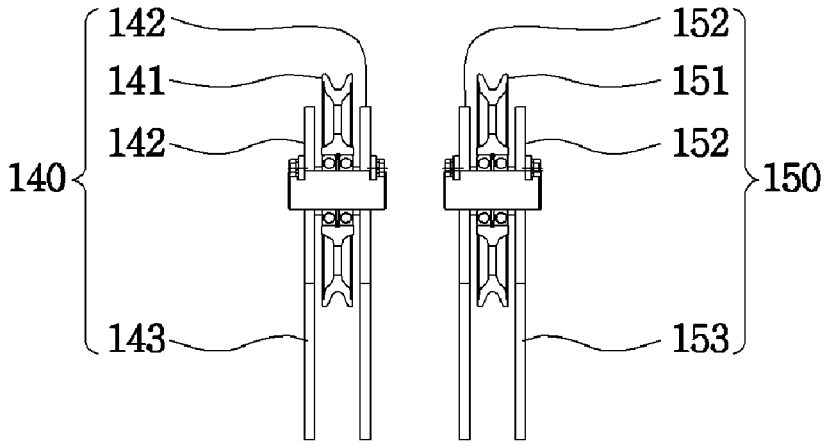
FIGS. 13 and 14 are a side view and a front view illustrating a first hook unit and a second hook unit.
Figure 14:
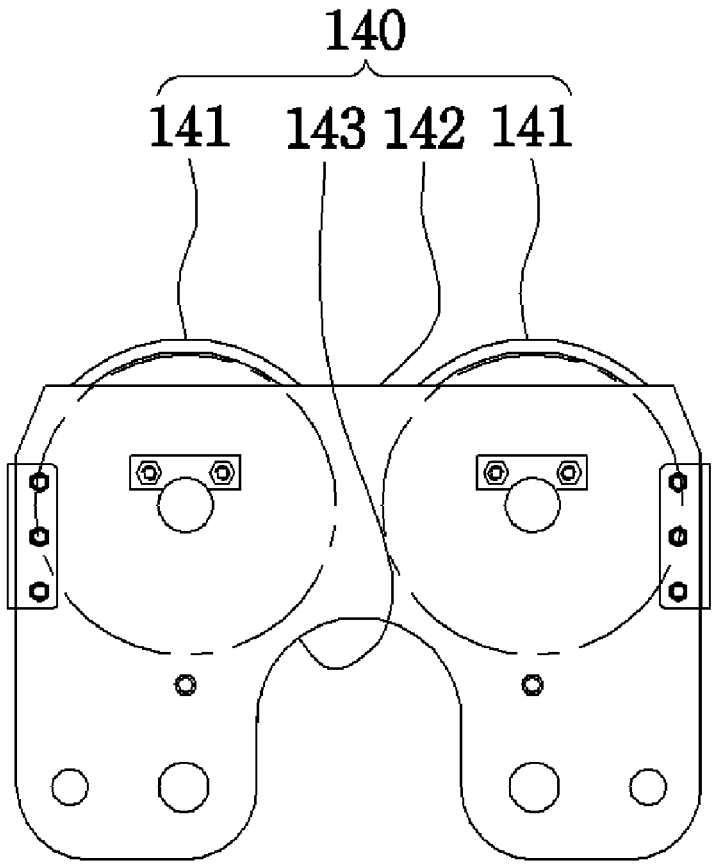

The first hook unit 140 is positioned at a lower side of the first rope ending unit 80, which corresponds to a first wire rope guide member, and a first wire rope 52 passes through the same. As shown in FIGS. 13 and 14, the first hook unit 140 comprises a first lower sheave 141 through which the first wire rope 52 passes, a first lower sheave bracket 142 which is installed at both sides of the first lower sheave 141 and has a first installation groove 143 at a center lower portion in which an upper end of the hook is positioned, and a first engaging piece 144 which transverses the first installation groove 143 and has both ends fixed at the first lower sheave bracket 142, with a hook being fixed at its center portion.

The second hook unit 150 is positioned at a lower side of the second rope ending unit 90, which corresponds to a second wire rope guide member, and a second wire rope 54 passes through the same. As shown in FIGS. 13 and 14, the second hook unit 150 comprises a second lower sheave 151 through which the second wire rope 54 passes, a second lower sheave bracket 152 which is installed at both sides of the second lower sheave 151 and has a second installation groove 153 at a center lower portion in which an upper end of the hook is positioned, and a second engaging piece 154 which transverses the second installation groove 153 and has both ends fixed at the second lower sheave bracket 152, with a hook being fixed at its center portion.

Figure 15:
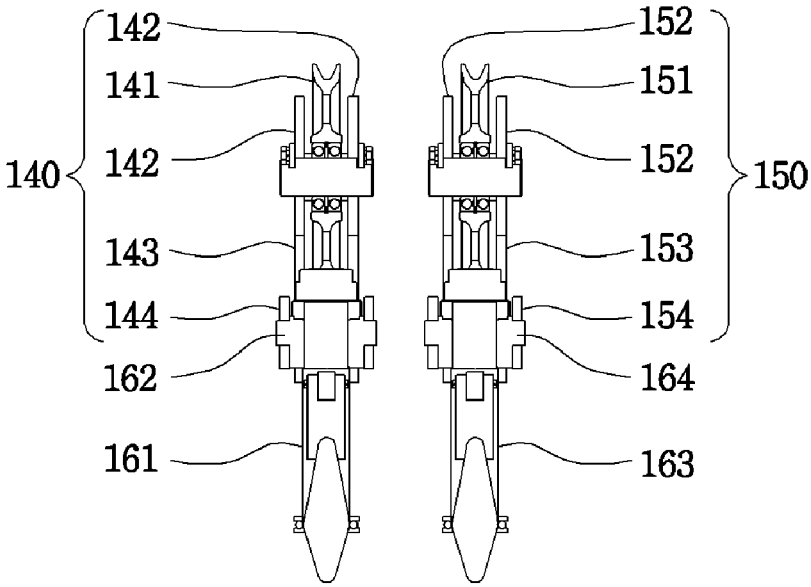
FIGS. 15 and 16 are a side view and a front view illustrating a state that a first hook and a second hook are installed in a first hook unit and a second hook unit, respectively.
Figure 16:
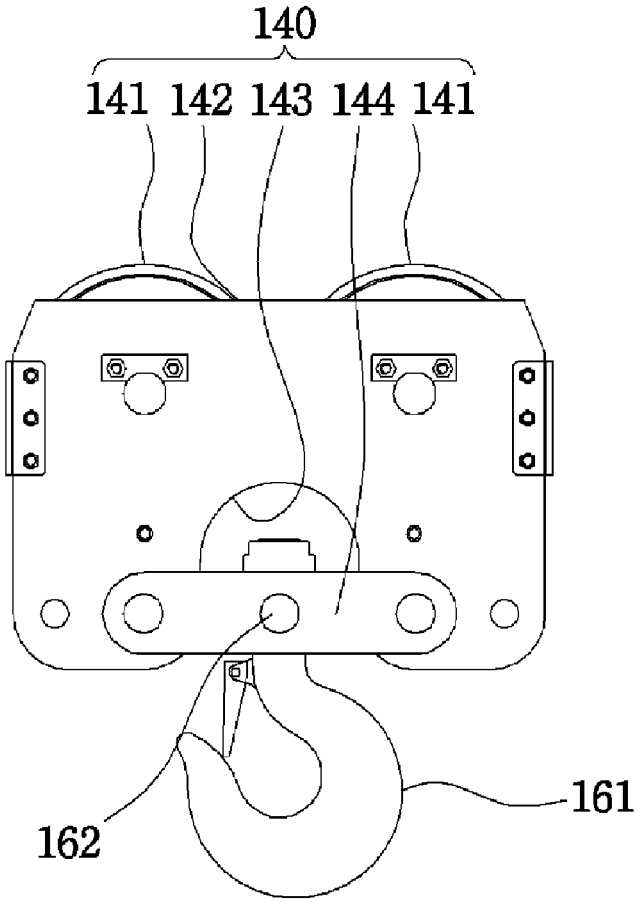

As shown in FIGS. 15 and 16, the first and second hooks 161 and 163 are installed in the first and second hook units 140 and 150. The first and second engaging pieces 144 and 154 traversing the first and second installation grooves 143 and 153 are fixed at the outer corresponding surfaces of the first and second lower sheave brackets 142 and 152. The upper ends of the first and second hooks 161 and 163 are positioned in the first and second installation grooves 143 and 153. In addition, the first and second hook pins 162 and 164 are engaged at the first engaging piece 144 and the first hook 161, and the second engaging piece 154 and the second hook 163, respectively.

The first and second hooks 161 and 163 are connected with two portions of the weight thing, and are used for transferring the weight thing.

Figure 17:
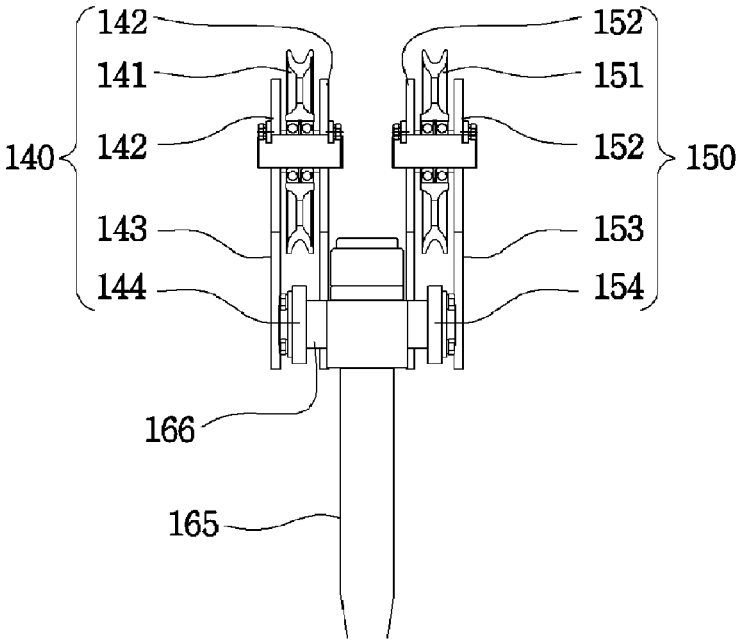
FIGS. 17 and 18 are a side view and a front view illustrating a state that one hook is installed in a first hook unit and a second hook unit.
Figure 18:
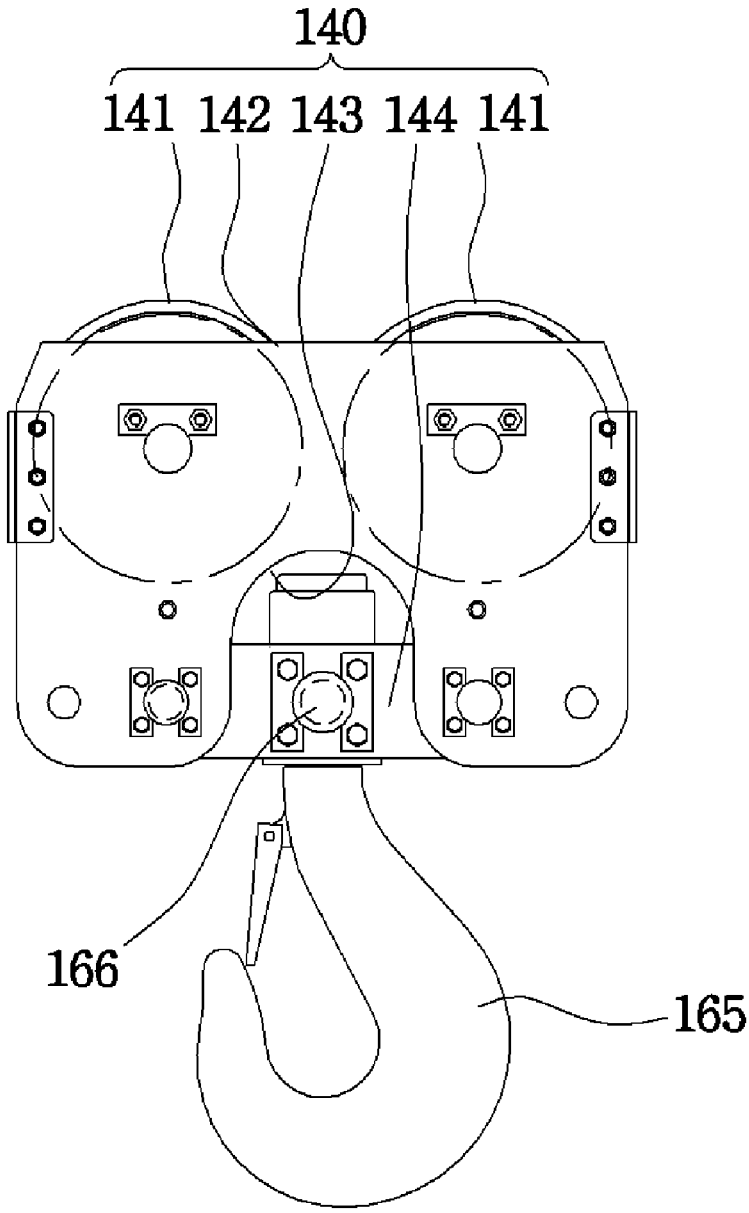

As shown in FIGS. 17 and 18, one hook 165 with a large capacity may be installed. The first and second engaging pieces 144 and 154 traversing the first and second installation grooves 143 and 153 are fixed on the corresponding inner surfaces of the first and second lower sheave brackets 142 and 152. An upper end of one hook 165 with a large capacity is positioned in the first and second installation grooves 143 and 153, respectively. The hook pin 166 is engaged to the first engaging piece 144, the hook 165, the second engaging piece 154 and the hook pin 166.

Since the hook 165 with a large capacity is supported by one point at the center upper portion of the weight thing H, it is generally used when transferring a weight thing H or when transferring the weight thing in a horizontal direction.

The upper end of the turnover jigger 170 is connected with the first and second hook units 140 and 150, respectively, and a weight thing H is fixed at a lower side of the same. As shown in FIGS. 5 through 10, the turnover jigger 170 comprises a first turnover jigger 180, a second turnover jigger 190, and a connection piece 200.

The first turnover jigger 180 comprises a first spacer bar 181 positioned at a lower side of the first hook unit 140, first connection wires 182 connected with the first hook unit 140 and both sides of the first hook unit 140, and a first turnover wire 183 which is connected with both sides of the first spacer bar 181 and is wound on the weight thing H. The second turnover jigger 190 comprises a second spacer bar 191 positioned at a lower side of the second hook unit 150, second connection wires 192 connected with the second hook unit 150 and both sides of the second spacer bar 191, and a second turnover wire 193 connected with both sides of the second spacer bar 191 and wound on the weight thing H. The connection piece 200 is connected with the first turnover wire 183, and the second turnover wire 193, respectively.

In the turnover jigger 170, the both sides of one side of the weight thing H are supported by means of the first turnover wires 183 of the first turnover jigger 180, and the other sides of the other side of the weight thing are supported by means of the second turnover wires 193 of the second turnover jigger 190. Four portions of both sides of the weight thing H are supported by means of the first and second turnover wires 183 and 193, so that the weight thing H can be stably supported by means of the turnover jigger 170.

The operation of the turning device for a hoist according to the present invention will be described.

The first and second turnover jiggers 180 and 190 are installed at the first and second hook units 140 and 150. The first connection wire 182 of the first turnover jigger 180 is fixed at both lower sides of the first lower sheave bracket 142, and the second connection wire 192 of the second turnover jigger 190 is fixed at both lower sides of the second lower sheave bracket 152.

Figure 10:
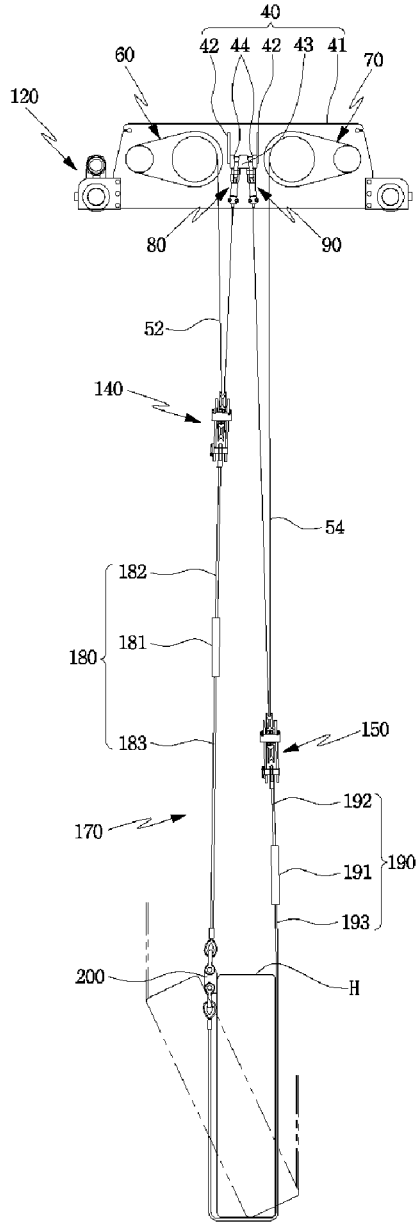
FIG. 10 is a view illustrating a state of use of a turning device for a hoist according to the present invention.

As shown in FIG. 10, when the first and second turnover jiggers 180 and 190 are connected with the first and second hook units 140 and 150, respectively, the turnover jigger 170 is installed around the weight thing H. Namely, the first turnover wire 183 of the first turnover jigger 180 is positioned at one side of the weight thing H, and the second turnover wire 193 of the second turnover jigger 190 is positioned at the other side of the weight thing H, and the end of the first turnover wire 183 and the end of the second turnover wire 193 are connected using the connection piece 200.

When the weight thing H is engaged at the turnover jigger 170, a certain weight thing is vertically turned over by operating a controller (not shown) or is moved to a certain place.

When the first or second drum driving unit 60 or 70 operates by means of the controller, the first or second wire rope 52 or 54 is wound or loosened, so that the first or second hook unit 140 or 150 moves up or down, and the first or second turnover jigger 180 or 190 moves up or down along with the same. As indicated by an imaginary line of FIG. 10, the weight thing H is turned over while being inclined in one direction.

As the first or second drum driving unit 60 or 70 operates, when the weight thing H is turned over to a desired place, the turning device including the weight thing H is transferred along a rain by operating the first and second horizontal driving units 120 and 130.

The turning device for a hoist according to the present invention has the following advantages.

First, the turning device for a hoist according to the present invention is able to stably support a weight thing with a narrow width.

The first and second wire drums 51 and 53 are installed in the integral installation bracket 41, and the first and second auxiliary brackets 43 and 45 are disposed between the first and second wire drums 51 and 53, and the first and second rope guide members are engaged at the first and second auxiliary brackets 43 and 45. Since the first and second rope guide members are installed as closer as possible, the first and second wire ropes 52 and 54 passing through the same, the first and second hook units 140 and 150 connected with the first and second wire ropes 52 and 54, and the first and second turnover jiggers 180 and 190 are installed as closer as possible from each other. So, as shown in FIG. 10, even when a weight thing H with a narrow width is supported by means of the turnover jigger 170, since the first and second turnover wires 183 and 193 are closely contacted with both sides of the weight thing H, the weight thing H can be more stably supported. During the turnover work, the weight thing H is not sharply inclined or swung.

Second, the first and second rope guide members are easily installed in the hoist frame 40 and are easily separated from the same. When the first hinge pins 84 and 103 of the first rope guide member and the second hinge pins 94 and 113 of the second rope guide member are mounted in the first pin groove 44 of the first auxiliary bracket 43 and the second pin groove 46 of the second auxiliary bracket 45, respectively, the first and second rope guide members can be easily installed in the hoist frame 40, and it is possible to easily separate the first and second rope guide members by separating the same from the first and second auxiliary brackets 43 and 45. The work for installing or separating the first and second guide members from the hoist frame 40 are very easy, and the assembling and maintenance are fast and easy.

Third, the first and second rope guide members are movable in opposite directions and are installed in the hoist frame 40. When the first hinge pins 84 and 103 of the first rope guide member and the second hinge pins 94 and 113 of the second rope guide member are installed in the first pin groove 44 of the first auxiliary bracket 43 and the second pin groove 46 of the second auxiliary bracket 45, respectively, the first and second rope guide members are freely movable in opposite directions with respect to the first and second pin grooves 44 and 46. When the space between the first and second wire ropes 52 and 54 is widened or narrowed depending on the width of the weight thing H, the first and second rope guide members are properly movable with respect to the first and second pin grooves 44 and 46 depending on the space between the varying first and second wire ropes 52 and 54. So, when the angle between the first and second wire ropes 52 and 54 increases or decreases, the angle between the first and second rope guide members increases or decreases, so that the first and second wire ropes 52 and 54 passing through the first and second rope guide members are not curved. So, it is possible to prevent part of the rope from being damaged owing to an over fatigue focused thereat.

Fourth, the first hook 161 and the second hook 163 or one large capacity hook 165 are selectively installed in the first and second hook units 140 and 150, and the turnover jigger 170 may be installed therein along with one of the same. The weight thing H is turned over using the turnover jigger 170, and when it is needed to horizontally move the weight thing H, one large capacity hook 165 installed in the first and second hook units 140 and 150 is used. When the weight thing H can be simply transferred using the first and second hooks 161 and 163 or one large capacity hook 165. So, it is possible to easily perform a vertical turn work, a horizontal rotation work, and a transfer work.

Figure 19:
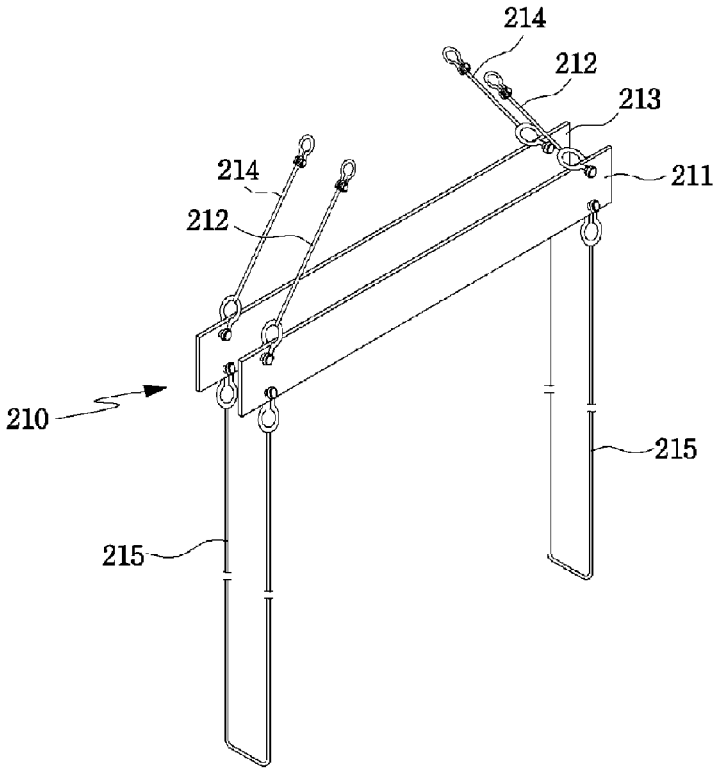
FIG. 19 is a schematic perspective view illustrating another example of a turnover jigger.

FIG. 19 is a schematic perspective view illustrating another example of the turnover jigger 210. The turnover jigger 210 comprises a first spacer bar 211 positioned at a lower side of the first hook unit 140, first connection wires 212 connected with the first hook unit 140 and both sides of the first spacer bar 211, respectively, a second spacer bar 213 positioned at a lower side of the second hook unit 150, second connection wires 214 connected with the second hook unit 150 and both sides of the second spacer bar 213, and an integral turnover wire 215 connected with both sides of the first and second spacer bars 211 and 213 and wound on a weight thing H.

The turnover jigger 210 has the same construction and effects as the turnover jigger 170 of FIGS. 5 through 8 except that the turnover wire 215 is integral.

Figure 20:
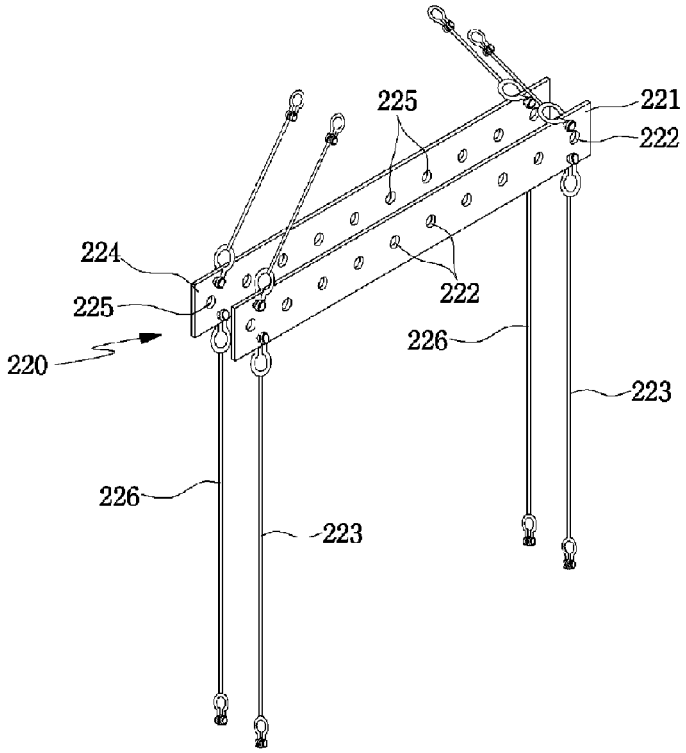
FIG. 20 is a schematic perspective view illustrating further another example of a turnover jigger.

FIG. 20 is a schematic perspective view illustrating another example of the turnover jigger 220. A plurality of space adjusting holes 222 and 225 are formed in the first and second spacer bars 221 and 224 of the turnover jigger 220, respectively, so that the upper ends of the first and second turnover wires 223 and 226 can be selectively engaged.

So, when the width of the weight thing H is relatively wider, the space between the upper sides of the first turnover wires 223 and the space between the upper sides of the second turnover wires 226 are substantially widened, and the widened upper sides are fixed at the corresponding space adjusting holes 222 and 225. When the width of both sides of the weight thing H is relatively narrow, the space between the upper sides of the first turnover wires 223 and the space between the upper sides of the second turnover wires 226 are properly narrowed, and the narrowed upper sides are fixed at the corresponding space adjusting holes 222 and 225.

In the turnover jigger 220, it is possible to properly adjust the space between a pair of the first turnover jiggers 223 and the space between a pair of the second turnover wires 226. So, even when the width of the both sides of the weight thing H is wide or narrow, four portions of both sides of the weight thing can be stably supported by means of the turnover jigger 220 of the present invention.

Figure 21:
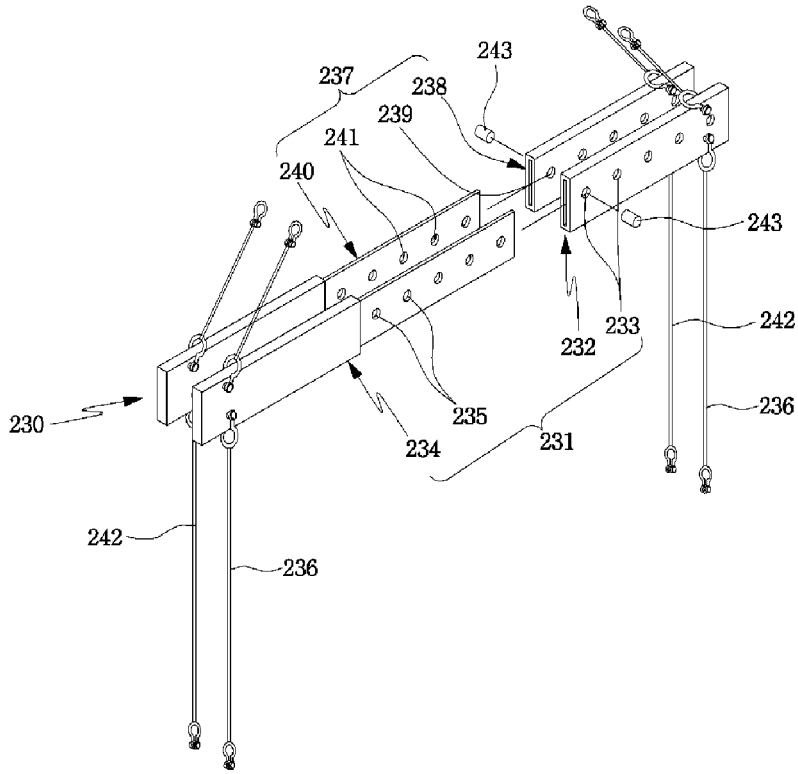
FIG. 21 is a schematic perspective view illustrating still further another example of a turnover jigger.

FIG. 21 is a schematic front view illustrating another example of the turnover jigger 230. The first spacer bar 231 of the turnover jigger 230 comprises a first unit bar 232 having a plurality of space adjusting holes 233, a second unit bar 234 of which one end is slide-inserted into the first unit bar 232, with other space adjusting holes 235 opposite to the space adjusting holes 233 being formed at a portion inserted into the first unit bar 232, and an engaging pin 243 which is engaged to the space adjusting holes 233 and 235 of the first and second unit bars 232 and 234 for thereby fixing the length-adjusted first and second unit bars 232 and 234.

The second spacer bar 237 of the turnover jigger 230 has the same construction as the first spacer bar 231 and comprises a first unit bar 238 having a plurality of space adjusting holes 239, a second unit bar 240 of which one end is slide-inserted into the first unit bar 238, with a plurality of space adjusting holes 241 opposite to the space adjusting holes 239 being formed at a portion inserted into the first unit bar 238, and an engaging pin 243 which is engaged with the space adjusting holes 239 and 241 of the first and second unit bars 238 and 240 for thereby fixing the length-adjusted first and second unit bars 238 and 240.

In the turnover jigger 230, it is possible to adjust the entire lengths of the first and second spacer bars 231 and 237 by inserting or separating one end of each of the second unit bars 234 and 240 from the first unit bars 232 and 238 so that the space between the first turnover wires 236 and the space between the second turnover wires 242 are matched with the width of both sides of the weight thing.

With the turnover jigger 230, the entire lengths of the first and second spacer bars 231 and 237 are adjusted, and the engaging pins 243 are engaged into the opposite space adjusting holes 233, 235, 239 and 241. So, it is possible to easily adjust the entire lengths of the first and second spacer bars 231 and 237 depending on the width of both sides of the weight thing. So, the weight thing can be stably supported by means of the turnover jigger 230.

INDUSTRIAL APPLICABILITY

As described above, when a weight thing with a narrow width is supported by means of the turnover jigger, since the first and second turnover wires are closely contacted with both sides of the weight thing, the weight thing can be stably supported. When the angle between the first and second wire ropes increases or decreases, the angle between the first and second rope guide members increases or decreases as well, so that the first and second wire ropes passing through the first and second rope guide members are prevented from being bended. Even when a width of both sides of the weight thing is wide or narrow, it is possible to stably support four portions of both sides of the weight thing with the help of the turnover jigger, so that a vertical turn work, a horizontal rotation work and a transfer work can be easily performed.

SEQUENCE LISTING hoist, turnover, wire drum, winding motor

The invention claimed is:

1. A turning device for a hoist, comprising:

a hoist frame which includes a pair of installation brackets having a first wire drum wound with a first wire rope, and a second wire drum wound with a second wire rope, a pair of support brackets disposed between the first and second wire drums and supported by the two installation brackets, and first and second auxiliary brackets fixed in the support brackets, respectively;

a first drum driving unit which includes a first winding motor installed at one side of the installation bracket, a first decelerator connected with the first winding motor and the first wire drum, respectively, and a first brake connected with the first decelerator;

a second drum driving unit which includes a second winding motor installed at the other side of the installation bracket, a second decelerator connected with the second winding motor and the second wire drum, respectively, and a second brake connected with the second decelerator;

a first horizontal driving unit which includes a first horizontal wheel installed at one of a pair of the installation brackets, and a first horizontal motor which is connected with the first horizontal wheel for thereby rotating the same;

a second horizontal driving unit which includes a second horizontal wheel installed at one of a pair of the installation brackets, and a second horizontal motor connected with the second horizontal wheel for rotating the same;

a first wire rope guide means which is disposed between the pair of the support brackets and is rotatably installed at one side of each of the first and second auxiliary brackets with the first wire rope passes through the first wire rope guide means;

a second wire rope guide means which is disposed between the pair of the support brackets and is rotatably installed at the other side of each of the first and second auxiliary brackets, with the second wire rope passing through the second wire rope guide means;

a first hook unit which is positioned at a lower side of the first wire rope guide means, with the first wire rope passing through the first hook unit;

a second hook unit which is positioned at a lower side of the second wire rope guide means, with the second wire rope passing through the second hook unit; and turnover jiggers of which an upper end of each jigger is connected with the first and second hook units, respectively, wherein first and second spacer bars of the turnover jigger are provided with a plurality of space adjusting holes, wherein said first and second spacer bars of the turnover jigger comprise:

first unit bars having a plurality of space adjusting holes;

second unit bars which have ends slide-inserted into the first unit bars, and space adjusting holes formed at the portions in which the first unit bars are inserted, and being opposite to the space adjusting holes; and an engaging pin which is engaged to the space adjusting holes of the first unit bars and the second unit bars, respectively, for thereby fixing the first unit bars and the second unit bars.

2. The device of claim 1, wherein said first and second auxiliary brackets provided with a first pin groove and a second pin groove which have an upper open portion, and a lower concave portion.

3. The device of claim 1, wherein first and second wire rope means are first and second rope ending units which include first and second fixing pieces to which an end of each of the first and second wire ropes is fixed, first and second engaging pieces of which lower ends are engaged to the first and second fixing pieces with first and second engaging pins, and first and second hinge pins which are provided at both sides of the upper ends of the first and second engaging pieces and are formed of the first and second hinge pins mounted in the first and second pin grooves.

4. The device of claim 1, wherein said first and second wire rope guide means are first and second upper sheave units which include first and second upper sheaves through which the first and second wire ropes pass, first and second upper sheave brackets installed at both sides of the first and second upper sheaves, and first and second hinge pins which are provided at both sides of the first and second upper sheave brackets and are mounted in the first and second pin grooves.

5. The device of claim 1, wherein said first and second hook units comprise first and second lower sheaves through which the first and second wire ropes pass, first and second lower sheave brackets installed at both sides of the first and second lower sheaves and have first and second installation grooves having center lower sides in which the upper ends of the hooks are positioned, and first and second engaging pieces which traverse the first and second installation grooves of which both ends are fixed at the first and second lower sheave brackets, respectively, with the hooks being fixed at the center portions of the same.

* * * * *